US010265961B2

(12) United States Patent
Sato et al.

(10) Patent No.: US 10,265,961 B2
(45) Date of Patent: Apr. 23, 2019

(54) WIPING MEMBER, LIQUID EJECTING APPARATUS, WIPING METHOD IN CLEANING MECHANISM, AND METHOD OF CONTROLLING LIQUID EJECTING APPARATUS

(71) Applicant: SEIKO EPSON CORPORATION, Tokyo (JP)

(72) Inventors: Mitsuru Sato, Suwa (JP); Satoshi Suzuki, Ageo (JP); Takashi Saiba, Shiojiri (JP); Yasutaka Matsumoto, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/913,142

(22) Filed: Mar. 6, 2018

(65) Prior Publication Data

US 2018/0264821 A1 Sep. 20, 2018

(30) Foreign Application Priority Data

Mar. 15, 2017 (JP) ..... 2017-049706

(51) Int. Cl.
*B41J 2/165* (2006.01)

(52) U.S. Cl.
CPC ..... *B41J 2/16535* (2013.01); *B41J 2/16544* (2013.01); *B41J 2/16552* (2013.01); *B41J 2002/1655* (2013.01); *B41J 2002/16558* (2013.01); *B41P 2235/24* (2013.01)

(58) Field of Classification Search
CPC . B41J 2/16535; B41J 2/16544; B41J 2/16552
See application file for complete search history.

(56) References Cited

U.S. PATENT DOCUMENTS 8,641,167 B2 * 2/2014 Love ..... B41J 2/16585 347/32
9,623,662 B2 * 4/2017 Seras Franzoso ... B41J 2/16535
2015/0124023 A1 5/2015 Hara et al.

FOREIGN PATENT DOCUMENTS

JP 2015-89658 A 5/2015

* cited by examiner

*Primary Examiner* — Lamson Nguyen
(74) *Attorney, Agent, or Firm* — Workman Nydegger

(57) ABSTRACT

A wiping member is configured to wipe a nozzle forming surface of a liquid ejecting head, which has nozzles through which a liquid is ejected, in a first direction. The wiping member includes a fibrous material and is configured to satisfy the following:

$$\mu a+3\sigma a \leq \mu f+3\sigma f$$

where μf is an average of sizes of spaces between fibers in the first direction, σf is a standard deviation of the sizes of the spaces, μa is an average of sizes of aggregation substances formed of a solute in the liquid adhered to the nozzle forming surface in the first direction, and σa is a standard deviation of the sizes of the aggregation substances.

20 Claims, 8 Drawing Sheets

WIPING MEMBER, LIQUID EJECTING APPARATUS, WIPING METHOD IN CLEANING MECHANISM, AND METHOD OF CONTROLLING LIQUID EJECTING APPARATUS

BACKGROUND

1. Technical Field

The present invention relates to a wiping member used to wipe a nozzle forming surface of a liquid ejecting head such as an ink jet recording head, to a liquid ejecting apparatus, to a wiping method in a cleaning mechanism, and to a method of controlling a liquid ejecting apparatus.

2. Related Art

A liquid ejecting apparatus includes a liquid ejecting head and is configured to eject (discharge) various kinds of liquids from the liquid ejecting head. A typical example of the liquid ejecting apparatus is an image recording apparatus such as an ink jet recording apparatus (hereinafter, simply referred to as a printer). The image recording apparatus includes an ink jet recording head (hereinafter, simply referred to as a recording head) as the liquid ejecting head and is configured to eject liquid ink in the form of liquid droplets from the recording head onto a recording medium such as recording paper, which is a landing target, to form dots constituting an image, for example. In these years, the liquid ejecting apparatus is not only used as an image recording apparatus. The liquid ejecting apparatus is applied to various apparatus such as an apparatus for producing displays, for example.

In the liquid ejecting apparatus including the liquid ejecting head, a cleaning mechanism for wiping the nozzle forming surface is provided, because the liquid ejected through the nozzles may adhere to and contaminate the nozzle forming surface. For example, JP-A-2015-89658 discloses a cleaning mechanism (cleaning apparatus) including a pile section in which a plurality of piles are raised at a portion of a wiping member (a cleaning member) in contact with the nozzle forming surface. The cleaning member formed of a cloth or the like includes pile elements formed of fibers each having a diameter smaller than 20 μm. This enables the pile elements to enter the nozzles and to readily remove solid materials in the nozzles.

Here, the above-described liquid ejecting head includes a liquid-repellent film on the nozzle forming surface to prevent ejection defects such as curve in flying direction caused by the liquid adhered around the nozzles and to improve wiping properties of the nozzle forming surface with the wiping member. This improves liquid repellent properties of the nozzle forming surface. If liquid is attached to the nozzle forming surface, the liquid gradually concentrates on the nozzle forming surface and an aggregation substance (agglomeration) of a solute dissolved in the liquid would be generated. If a wiping member wipes the nozzle forming surface having the aggregation substance thereon without any countermeasures, the liquid-repellent film is likely to be damaged by the aggregation substance sliding on the nozzle forming surface. In particular, the liquid ejecting head may eject liquid containing a relatively hard component such as titanium oxide as the solute. In such a case, the liquid-repellent film on the nozzle forming surface is damaged by the hard aggregation substance (the adhered substance) sliding on the nozzle forming surface. This lowers the liquid-repellent properties.

SUMMARY

An advantage of some aspects of the invention is that a wiping member, a liquid ejecting apparatus, a wiping method in a cleaning mechanism, and a method of controlling a liquid ejecting apparatus, which are less likely to damage a liquid-repellent film on a nozzle forming surface, are provided.

According to an aspect of the invention, a wiping member is configured to wipe a nozzle forming surface of a liquid ejecting head, which has nozzles through which a liquid is ejected, in a first direction. The wiping member includes a fibrous material and configured to satisfy the following:

$$\mu a+3\sigma a \leq \mu f+3\sigma f$$

where μf is an average of sizes of spaces between fibers in the first direction, σf is a standard deviation of the sizes of the spaces, μa is an average of sizes of aggregation substances formed of a solute in the liquid adhered to the nozzle forming surface in the first direction, and σa is a standard deviation of the sizes of the aggregation substances.

According to the aspect of the invention, the cleaning operation performed with the above-described condition being satisfied allows the aggregation substances on the nozzle forming surface to be readily caught in the spaces in the wiping member. Since the aggregation substances are caught in the spaces, the nozzle forming surface is less likely to be rubbed by aggregation substances sandwiched between the fibers of the wiping member and the nozzle forming surface. Thus, the liquid-repellent film on the nozzle forming surface is less likely to be damaged and worn by the aggregation substances, reducing deterioration in the liquid-repellent properties.

In the above-described configuration, the average μf of the sizes of the spaces may satisfy the following:

$$\mu a-2\sigma a \leq \mu f \leq \mu a+2\sigma a.$$

This configuration allows the average μf of the sizes of the spaces and the average μa of the sizes of the aggregation substances to be close to each other. Thus, the aggregation substances are more reliably caught in the spaces during the cleaning operation.

In the above-described configuration, an area density of the spaces may be larger than an area density of the aggregation substances on the nozzle forming surface.

With this configuration, since the area density of the spaces is larger than that of the aggregation substances on the nozzle forming surface, more aggregation substances are more reliably caught.

Furthermore, according to an aspect of the invention, a wiping member is configured to wipe a nozzle forming surface of a liquid ejecting head, which has nozzles through which liquid is ejected, in a first direction. The wiping member includes a fibrous material. The wiping member has spaces capable of catching aggregation substances formed of a solute of the liquid attached to the nozzle forming surface between fibers. The wiping member satisfies the following:

$$\mu a1+3\sigma a1 \leq \mu s1+3\sigma s1; \text{ and}$$

$$\mu a2+3\sigma a2 \leq \mu s2+3\sigma s2$$

where μs1 is an average of widths of the spaces in the first direction, σs1 is a standard deviation of the widths of the spaces, μs2 is an average of depths of the spaces in a second direction extending in a thickness direction of the wiping member, σs2 is a standard deviation of the depths of the spaces, μa1 is an average of sizes of the aggregation substances in the first direction, σa1 is a standard deviation of the sizes of the aggregation substances, μa2 is an average of thicknesses of the aggregation substances in the second direction, and σa2 is a standard deviation of the thicknesses of the aggregation substances.

According to the aspect of the invention, the cleaning operation performed with the above-described condition being satisfied allows the aggregation substances on the nozzle forming surface to be readily caught in the spaces in the wiping member. Since the aggregation substances are caught in the spaces, the nozzle forming surface is less likely to be rubbed by aggregation substances sandwiched between the fibers of the wiping member and the nozzle forming surface. Thus, the liquid-repellent film on the nozzle forming surface is less likely to be damaged and worn by the aggregation substances, reducing deterioration in the liquid-repellent properties.

In the above-described configuration, the average μs1 of the widths of the spaces and the average μs2 of the depths of the spaces respectively may satisfy the following:

$$\mu a1-2\sigma a1 \leq \mu s1 \leq \mu a1+2\sigma a1; \text{ and}$$

$$\mu a2-2\sigma a2 \leq \mu s2 \leq \mu a2+2\sigma a2.$$

This configuration allows the average μs1 of the widths of the spaces and the average μa1 of the sizes of the aggregation substances to be close to each other and the average of μs2 of the depths of the spaces and the average μa2 of the thicknesses of the aggregation substances to be close to each other. Thus, the aggregation substances are more reliably caught in the spaces during the cleaning operation.

In the above-described configuration, an area density of the spaces may be larger than an area density of the aggregation substances on the nozzle forming surface.

With this configuration, since the area density of the spaces is larger than that of the aggregation substances on the nozzle forming surface, more aggregation substances are able to be more reliably caught in the spaces.

In the above-described configuration, the wiping member may include a plurality of layers arranged in the second direction, and at least one of the plurality of layers that is in contact with the nozzle forming surface may have the spaces.

With this configuration, since the wiping member includes another layer in addition to the layer configured to catch the aggregation substances, the wiping member is able to be provided with another property such as improved elasticity.

A liquid ejecting apparatus according to another aspect of the invention includes a liquid ejecting head having a nozzle forming surface having nozzles through which liquid is ejected, and a cleaning mechanism configured to wipe the nozzle forming surface by using any one of the above-described wiping members.

According to this aspect of the invention, the liquid-repellent film on the nozzle forming surface is less likely to be damaged and worn by the aggregation substances, reducing deterioration in the liquid-repellent properties. This leads to an improvement in resistance of the liquid ejecting head.

Another aspect of the invention provides a wiping method in a cleaning mechanism of wiping a nozzle forming surface of a liquid ejecting head having nozzles through which liquid is ejected by using the wiping member according to any one of the above-described wiping members. The method includes applying a force to the wiping member such that a space between the fibers of the wiping member is made larger than a size of the aggregation substances in the first direction and wiping the nozzle forming surface with the wiping member.

According to the aspect of the invention, since the cleaning operation is performed with the spaces between the fibers of the wiping member in the first direction being made larger than the size of the aggregation substance in the first direction, the aggregation substance on the nozzle forming surface is readily caught in the spaces of the wiping member. In particular, this configuration is preferably applied to a wiping member in which a space between the fibers with no force being applied is smaller than the size of the aggregation substance at the time of the wiping operation.

In the above-described method, the force may be varied depending on an elapsed time from a previous cleaning operation or a total ejection amount of the liquid ejected from the liquid ejecting head.

The size of the aggregation substance increases as the elapsed time from the previous cleaning operation becomes longer or the total ejection amount of ink ejected from the liquid ejecting head increases. Thus, this method varies a degree of the force accordingly to more effectively catch the aggregation substance.

The above-described method may further include applying a cleaning liquid including the same kind of liquid as a solvent in the liquid to the nozzle forming surface or the wiping member before the wiping member comes in contact with the nozzle forming surface.

This method allows the aggregation substances adhered to the nozzle forming surface to be more readily removed.

Another aspect of the invention provides a method of controlling a liquid ejecting apparatus including a liquid ejecting head having a nozzle forming surface having nozzles through which liquid is ejected and a cleaning mechanism configured to wipe the nozzle forming surface with a wiping member. In the method, any one of the wiping methods in the cleaning mechanism is employed.

According to the aspect of the invention, the liquid-repellent film on the nozzle forming surface is less likely to be damaged and worn by the aggregation substances, reducing deterioration in the liquid-repellent properties. This leads to an improvement in resistance of the liquid ejecting head.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the present invention will be described with reference to the drawings. Although various limitations are made in the embodiments described below in order to illustrate specific preferred examples of the invention, it should be noted that the scope of the invention is not limited to these features unless such limitations are explicitly mentioned to limit the invention in the following description. In the embodiments, an image recording apparatus, which is an example of a liquid ejecting apparatus, more specifically, an ink jet printer (hereinafter, may be referred to as a printer) provided with an ink jet recording head (hereinafter, may be simply referred to as a recording head) as a liquid ejecting head is described as an example.

Figure 1:
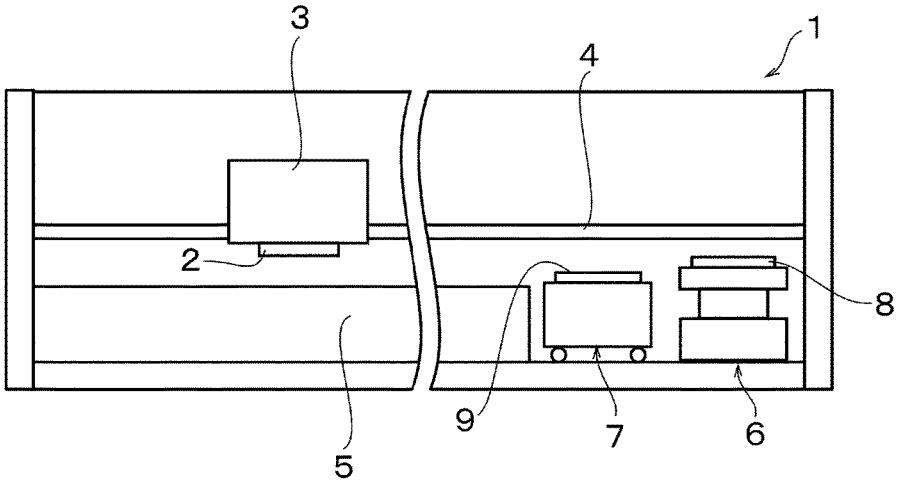
FIG. 1 is a front view illustrating a configuration of a liquid ejecting apparatus (a printer) according to an embodiment.
Figure 2:
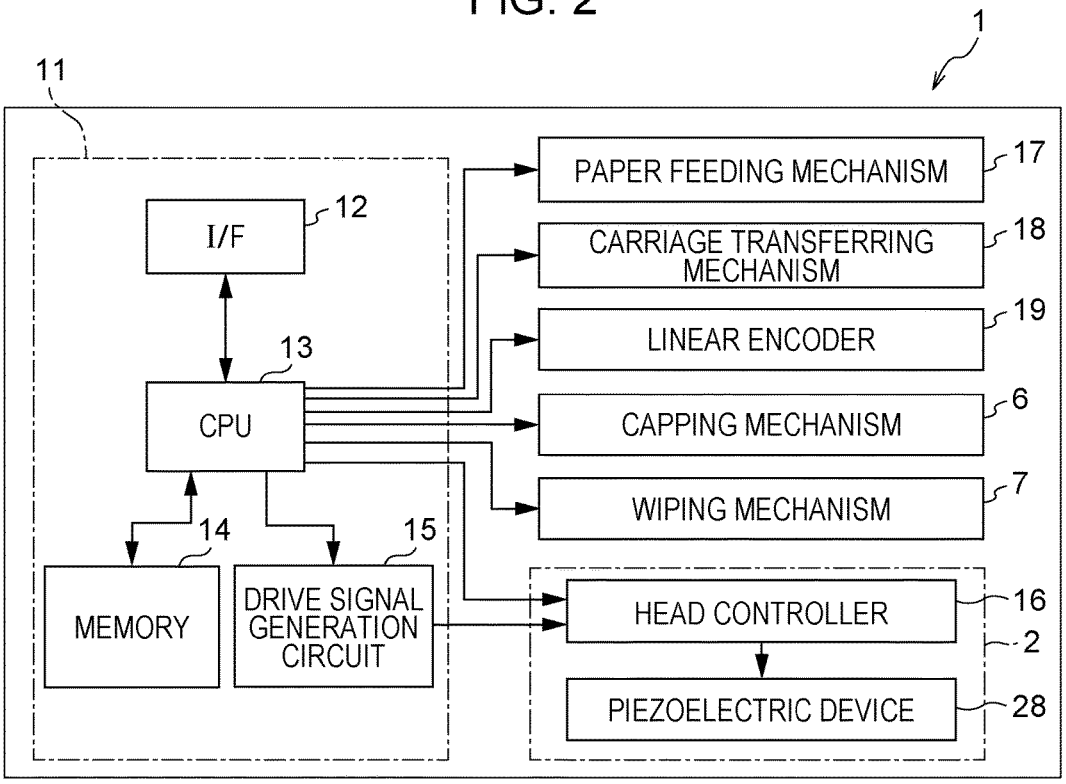
FIG. 2 is a block diagram of an electrical configuration of the liquid ejecting apparatus.

FIG. 1 is a front view illustrating a configuration of a printer 1. FIG. 2 is a block diagram of an electrical configuration of the printer 1. A recording head 2, which is one example of a liquid ejecting head, is attached to a lower surface of a carriage 3 provided with an ink cartridge (a liquid supply source). The carriage 3 is configured to be reciprocated along a guide rod 4 by a carriage transferring mechanism 18. In other words, in the printer 1, a paper feeding mechanism 17 sequentially transfers recording media onto a platen 5, and the recording head 2 ejects ink droplets, which is one example of the liquid in the invention, through nozzles 40 (see FIG. 3 and FIG. 4) onto the recording medium while the recording head 2 is moved in the width direction (a main scanning direction) of the recording medium. The printer 1 forms an image, for example, in this way. The ink cartridge may be located in a main body of the printer, and the ink in the ink cartridge may be sent to the recording head 2 through a supply tube.

In the printer 1 according to the embodiment, an ink may include a coloring matter and a solvent for dispersing or dissolving the coloring matter. The coloring matter may be a pigment, and examples thereof include azo pigments, such as insoluble azo pigments, condensed azo pigments, azo lake pigments, and chelate azo pigments, polycyclic pigments, such as phthalocyanine pigments, perylene and perinone pigments, anthraquinone pigments, quinacridone pigments, dioxazine pigments, thioindigo pigments, isoindolinone pigments, and quinophthalone pigments, dye chelates, dye lake, nitro pigments, nitroso pigments, aniline black, daylight fluorescent pigments, carbon black, and base metal pigments. Further examples of the pigments include inorganic materials (black pigments), such as oxide copper and manganese dioxide and inorganic materials, such as zinc oxide, titanium oxide, antimony white, and zinc sulfide. Examples of dyes include direct dyes, acid dyes, food dyes, basic dyes, reactive dyes, disperse dyes, vat dyes, soluble vat dyes, and reactive disperse dyes. Examples of the solvent for water based ink include pure water, such as ion exchanged water, ultrafiltrated water, reverse osmosis water, and distilled water, and ultrapure water. The solvent in oil-based ink may contain volatile organic solvent, such as ethylene glycol and propylene glycol. Furthermore, the ink may contain, in addition to the coloring matter and the solvent, a basic catalyst, a surfactant, a tertiary amine, a thermoplastic resin, a pH adjuster, a buffer solution, a fixing agent, an antiseptic agent, an antioxidizing agent, a ultraviolet absorbing agent, a chelating agent, and/or an oxygen absorber, for example.

In particular, the ink containing a relatively hard component such as titanium oxide (TiOx) as a solute may be attached to a nozzle forming surface 23 when ejected through the nozzles 40 or when maintenance (cleaning) is performed. The ink may gradually aggregate on the nozzle forming surface 23 and generate an aggregation substance of components (a solute) included in the ink. The aggregation substance tends to become larger with time. If the nozzle forming surface 23 having the aggregation substances thereon is wiped by a wiping mechanism 7 without any countermeasures, a liquid-repellent film 47 is likely to be damaged by the aggregation substance sliding on the nozzle forming surface 23. In the printer 1 according to the invention, the aggregation substances are less likely to damage the nozzle forming surface 23 when the nozzle forming surface 23 having the aggregation substances thereon is wiped by the nozzle wiping mechanism 7. This will be described in detail later.

In the printer 1, a home position, which is a standby position of the recording head 2, is set at a position away from the platen 5 toward one end in the main scanning direction (the right side in FIG. 1). At the home position, a capping mechanism 6 (one example of a sealing mechanism) and a wiping mechanism 7 (one example of a cleaning mechanism of the invention) are arranged in this order from the one end. The capping mechanism 6 includes a cap 8 formed of an elastic member such as elastomer, for example. The capping mechanism 6 is configured to move the cap 8 to a sealing position (a capping position) at which the cap 8 is in contact with the nozzle forming surface 23 of the recording head 2 or to a retracted position away from the nozzle forming surface 23. In the capping mechanism 6, the space in the cap 8 functions as a sealing space, and the nozzles 40 of the recording head 2 face the sealing space when the nozzle forming surface 23 is sealed. In addition, a pump unit (a suction unit), which is not illustrated, is connected to the capping mechanism 6, and the pressure in the sealing space is able to be made negative by activation of the pump unit. In the maintenance (cleaning), the pump unit is activated while the cap 8 is in close contact with the nozzle forming surface 23. Thus, the pressure in the sealing space is made negative, and the ink and bubbles in the recording head 2 are suctioned through the nozzles 40 and discharged into the sealing space of the cap 8.

The wiping mechanism 7 in this embodiment includes a wiper 9, which is one example of a wiping member, in a slidable manner in a direction intersecting the main scanning direction of the recording head 2, or in a nozzle line direction, which is described later. The wiping mechanism 7 causes the wiper 9 in contact with the nozzle forming surface 23 to slide to perform a cleaning operation (a wiping operation) in which the nozzle forming surface 23 is wiped. The wiping mechanism 7 is described in detail later.

In the printer 1 according to the embodiment, a printer controller 11 controls the components. The printer controller 11 according to the embodiment includes an interface (I/F) section 12, a CPU 13, a memory 14, and a drive signal generation circuit 15. The interface section 12 is configured to receive printing data and a printing order from an external device, such as a computer and a mobile information terminal, and to output information about the status of the printer 1 to an external device. The memory 14 is a device configured to store data for a program of the CPU 13 or for various controls and may be ROM, RAM, or a non-volatile memory (NVRAM).

The CPU 13 controls the units in accordance with the programs stored in the memory 14. The CPU 13 according to the embodiment is configured to generate ejection data about which ones of the nozzles 40 of the recording head 2 are used to eject the ink, timing for ejection, and the size (amount) of ink to be ejected in the recording operation, based on the printing data from an external device, for example, and send the ejection data to a head controller 16 of the recording head 2. In addition, the CPU 13 is configured to generate a timing signal such as a latch signal LAT from an encoder pulse output from a linear encoder 19 and to output the timing signal to the head controller 16 of the recording head 2. The head controller 16 is configured to selectively apply a drive pulse in the drive signal to a piezoelectric device 28 (see FIG. 3) based on the ejection data and the timing signal. This activates the piezoelectric device 28 to eject ink droplets through the nozzles 40 or to slightly vibrate the ink droplets such an extent that the ink droplets are not ejected from the nozzles 40. The drive signal generation circuit 15 is configured to generate a driving signal including a drive pulse that is used to eject ink droplets onto a recording medium to form an image, for example.

Figure 3:
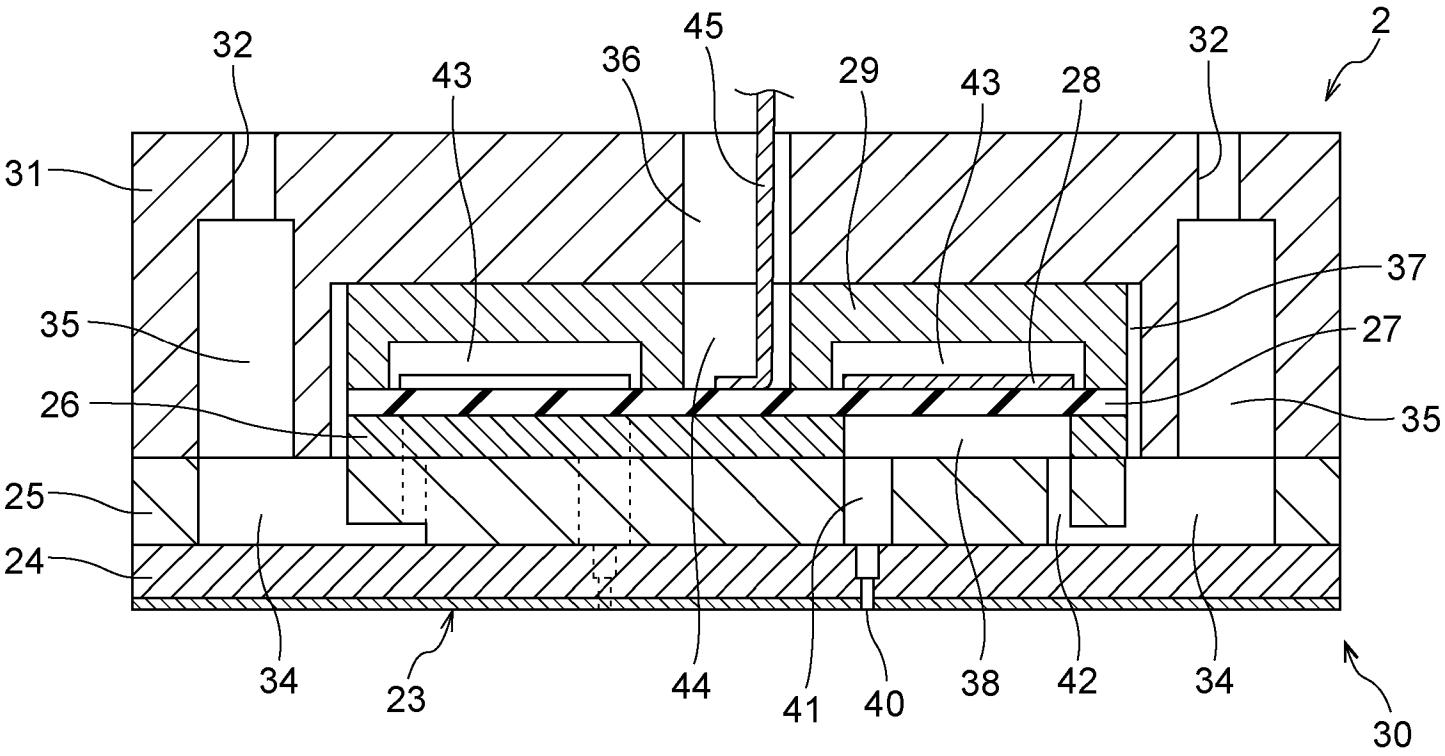
FIG. 3 is a cross-sectional view illustrating a configuration of a liquid ejecting head (a recording head) according to an embodiment.

FIG. 3 is a cross-sectional view illustrating a configuration of the recording head 2, which is one example of the liquid ejecting head. The recording head 2 in this embodiment includes a discharge unit 30 including a nozzle plate 24, a communication substrate 25, a pressure chamber formation substrate 26, a vibration plate 27, the piezoelectric device 28, and a protection substrate 29, which are laminated and bonded by an adhesive, for example. The discharge unit 30 is attached to a unit case 31. The unit case 31 has inlets 32, through which ink is introduced from the ink cartridge, and case passages 35, through which the ink introduced through the inlets 32 is introduced to a common liquid chamber 34. The unit case 31 includes a wiring space 36 at the middle in plan view. The wiring space 36 is in communication with a wiring connection space 44 in the protection substrate 29, which will be described later. The lower portion of the unit case 31 includes a storage space 37 having a cuboidal shape extending from the lower surface to the middle of the unit case 31 in height. The storage space 37 houses the pressure chamber formation substrate 26, the vibration plate 27, the piezoelectric device 28, and the protection substrate 29 of the discharge unit 30. In this state, the upper surface of the communication substrate 25 of the discharge unit 30 is attached to the lower surface of the unit case 31.

The pressure chamber formation substrate 26 in this embodiment is formed of a silicon substrate, for example. In the pressure chamber formation substrate 26, pressure chamber spaces, which define pressure chambers 38, are formed by anisotropic etching at positions corresponding to the nozzles 40 in the nozzle plate 24. One of openings (an upper opening) of each pressure chamber space in the pressure chamber formation substrate 26 is sealed by the vibration plate 27. The communication substrate 25 is attached to the surface of the pressure chamber formation substrate 26 opposite the vibration plate 27, and the other of the openings of the pressure chamber space is sealed by the communication substrate 25. Thus, the pressure chamber 38 is defined. Here, the portion corresponding to the upper opening of the pressure chamber 38 sealed by the vibration plate 27 is a flexible surface, which is deformed when the piezoelectric device 28 is activated.

The pressure chamber 38 in the embodiment is a space elongated in a direction perpendicular to an arrangement direction of the nozzles 40, in which the nozzles 40 are arranged side by side. The pressure chamber 38 is in communication with the nozzle 40 at one end in the longitudinal direction through a nozzle communication hole 41 in the communication substrate 25. The pressure chamber 38 is in communication with the common liquid chamber 34 at the other end in the longitudinal direction through an individual communication hole 42 in the communication substrate 25. The pressure chambers 38 are arranged side by side for the corresponding nozzles 40. The communication substrate 25 is a plate member formed of a silicon substrate as the pressure chamber formation substrate 26. The communication substrate 25 includes a space formed by anisotropic etching. The space is used as the common liquid chamber 34 (may be referred to as a reservoir or a manifold) shared by the pressure chambers 38 in the pressure chamber formation substrate 26. The common pressure chamber 34 is a space elongated in the arrangement direction of the pressure chambers 38. The pressure chambers 38 are in communication with the common liquid chamber 34 through the individual communication holes 42.

The nozzle plate 24 is a plate member including the nozzles 40 arranged in a line. In the embodiment, the nozzles 40 are arranged in a line at a pitch corresponding to a dot formation density. In the recording head 2 in the embodiment, the nozzle line includes the nozzles 40 arranged in a sub scanning direction (a transfer direction of a recording medium) intersecting the main scanning direction. The nozzle plate 24 in the embodiment is formed of a silicon substrate, for example, and the nozzles 40 each having a cylindrical shape are formed by dry etching on the substrate. The nozzle plate 24 has the nozzle forming surface 23 from which the ink is ejected (the surface opposite the communication substrate 25). The recording head 2 may include a fixation board, which fixes the recording head 2, around the nozzle plate 24. In such a configuration, the nozzle forming surface 23 is constituted by the surface of the nozzle plate 24 and the surface of the fixation board (the surfaces facing the recording medium or the like during a recording operation).

Figure 4:
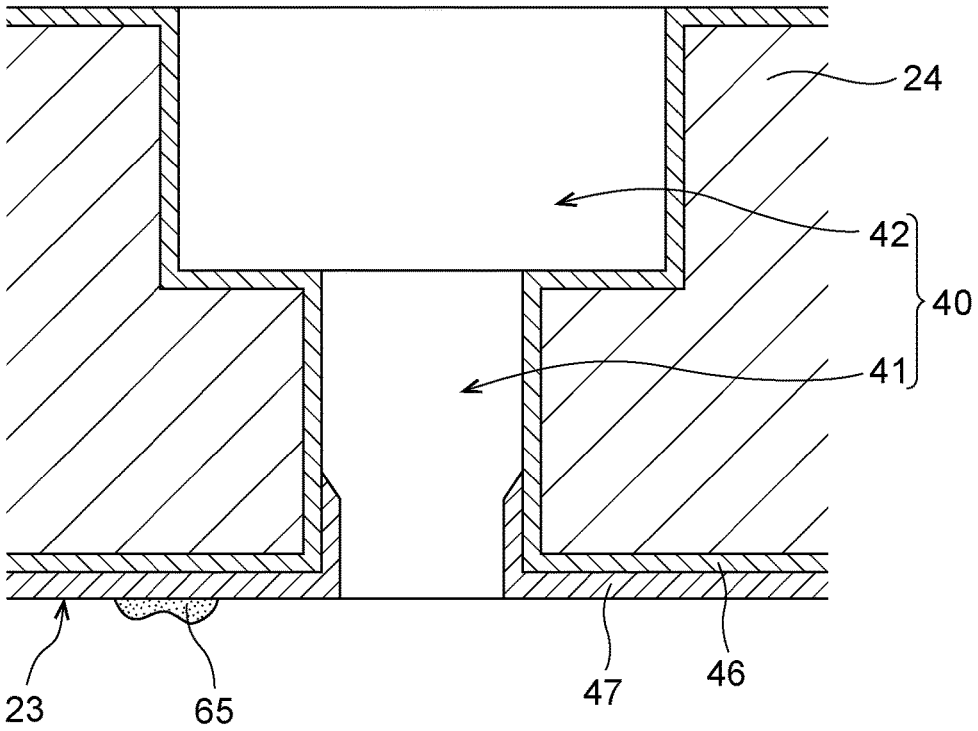
FIG. 4 is a cross-sectional view illustrating a nozzle.

FIG. 4 is a cross-sectional view of the nozzle 40 taken along a central axis thereof (an ink ejection direction). In FIG. 4, the upper side is an upstream side (adjacent to the pressure chamber 38) in the ink ejection direction, and the lower side is a downstream side (adjacent to the recording medium during a recording operation) in the ink ejection direction. The nozzle 40 in this embodiment has a two-step cylindrical shape and includes a first nozzle portion 41 at the downstream side and a second nozzle portion 42 at the upstream side. The cross-sectional area of the first nozzle portion 41 is smaller than that of the second nozzle portion 42. The first and second nozzle portions 41 and 42 each have a circular shape in plan view. The ink is ejected through the opening of the first nozzle portion 41 opposite the second nozzle portion 42. The second nozzle portion 42 may have a tapered inner surface and may have an inner diameter gradually increasing from the downstream side (adjacent to the first nozzle portion 41) toward the upstream side (adjacent to the pressure chamber 38).

The nozzle forming surface 23 of the nozzle plate 24 has a liquid-repellent film 47 thereon with a protective film 46 therebetween. The protective film 46 covers all the surface of the nozzle plate 24 including the inner surfaces of the nozzles 40 with an oxide film (SiOx), which is not illustrated, therebetween. The protective film 46 protects the base material of the nozzle plate 24 from the ink. The protective film 46 also functions as a base film for connecting the base material of the nozzle plate 24 and the protective film 46 to each other. This makes the liquid-repellent film 47 less likely to be detached from the nozzle forming surface 23. The liquid-repellent film 47 on the protective film 46 has liquid-repellent properties. A liquid-repellent agent (a silane coupling agent) containing fluorine, for example is coated to form the liquid-repellent film 47. Examples of the liquid-repellent agent include fluoroalkyl group-containing silane compounds, such as (trifluoropropyl)trimethoxysilane. Furthermore, the liquid-repellent film 47 may be formed by vapor deposition such as PVD, CVD, and ALD, instead of coating.

The vibration plate 27 on the upper surface of the pressure chamber formation substrate 26 is formed of silicon dioxide and has a thickness of about 1 μm. An insulating film, which is not illustrated, is formed on the vibration plate 27. The insulating film is formed of zirconium oxide, for example. The piezoelectric devices 28 are disposed on the vibration plate 27 or the insulating film at positions corresponding to the pressure chambers 38. The piezoelectric device 28 in the embodiment includes a metallic lower electrode film, a piezoelectric material layer formed of lead zirconate titanate (PZT), and a metallic upper electrode film (all of which are not illustrated) in this order on the vibration plate 27 or the insulating film. In this configuration, one of the upper electrode film and the lower electrode film is a common electrode, and the other is an individual electrode. The electrode film as the individual electrode and the piezoelectric material layer are patterned for each of the pressure chambers 38.

The protection substrate 29 is disposed above the upper surface of the communication substrate 25 on which the pressure chamber formation substrate 26 and the piezoelectric device 28 are disposed. The protection substrate 29 is formed of glass, a ceramic material, a silicon single-crystal substrate, a metal, or a synthetic resin, for example. The protection substrate 29 has a recess 43 having a size that does not inhibit the driving of the piezoelectric device 28 in a region facing the piezoelectric device 28. In addition, the protection substrate 29 includes the wiring connection space 44 extending therethrough in the thickness direction at the middle. In the wiring connection space 44, a terminal of the piezoelectric device 28 and one end of a flexible substrate 45 are positioned. When driving signals (driving voltages) are applied from the printer controller 11 to the piezoelectric device 28 through the flexible substrate 45, the piezoelectric activating portion of the piezoelectric device 28 is deformed depending on changes in the applied voltages. This causes the flexible surface defining a surface of the pressure chamber 38, i.e., the vibration plate 27, to be displaced toward the nozzles 40 or away from the nozzles 40. Thus, fluctuation of the ink pressure occurs in the pressure chamber 38, and the ink is ejected through the nozzles 40 due to the fluctuation of the ink pressure.

The ink (an ink droplet) ejected through the nozzle 40 of the recording head 2 is very small and has a mass of about a few nanograms (ng) to about a dozen nanograms (ng). Thus, micro mist may be generated by the ejection and the mist may be adhered to the nozzle forming surface 23. Furthermore, the ink may be adhered to the nozzle forming surface 23 in the cleaning process in which the ink is ejected through the nozzles 40 with the cap 8 sealing the nozzle forming surface 23. The ink adhered to the nozzle forming surface 23 aggregates on the nozzle forming surface 23, and an aggregation substance (agglomeration) of the solute of the ink, i.e., the component such as the pigment, is generated. The aggregation substance becomes larger with time through repeated ejection of the ink through the nozzles 40. For example, the ink may contain titanium oxide (TiOx) particles, and the size of the particle may be about 0.25 μm. In this case, the size of the aggregation substance including the titanium oxide may be about 100 μm, for example, if the time elapsing from one wiping operation to the next wiping operation is long or the total number of ejection through the nozzles 40 (the total ejection amount) is large. When the wiping mechanism 7 wipes the nozzle forming surface 23 having the aggregation substance thereon, the wiper 9 may drag the aggregation substance while pressing it against the nozzle forming surface 23. This may damage the liquid-repellent film 47, and thus the liquid-repellent film 47 may be deteriorated. The wiper 9 according to the invention has a configuration in which the liquid-repellent film 47 on the nozzle forming surface 23 is less likely to be damaged by the wiping operation performed on the nozzle forming surface 23 having the aggregation substance thereon. This feature is described below.

Figure 5:
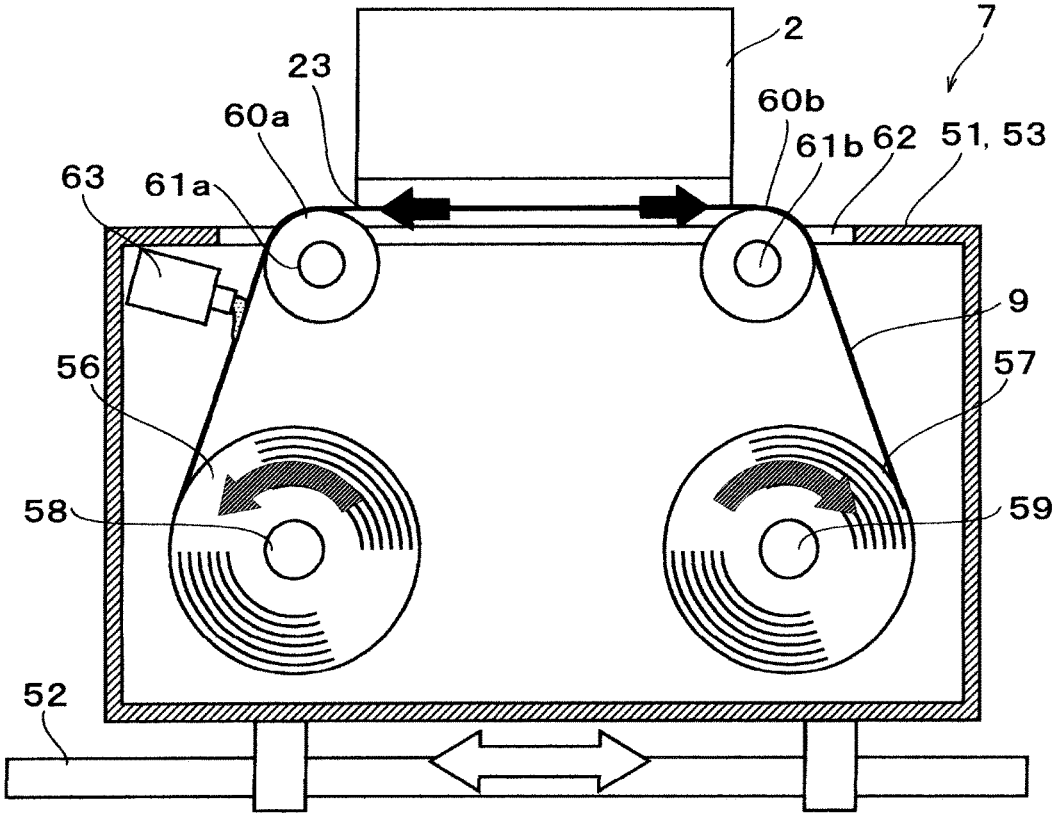
FIG. 5 is a cross-sectional view illustrating a configuration of a cleaning mechanism (a wiping mechanism) according to an embodiment.

FIG. 5 is a schematic view illustrating a configuration of the wiping mechanism 7, which is one example of the cleaning mechanism. In FIG. 5, the wiping mechanism 7 is illustrated in cross section taken in the sub scanning direction (the nozzle line direction of the recording head 2 in this embodiment), which intersects the main scanning direction. The wiping mechanism 7 in the embodiment has a unit main body 51 slidably attached to a rail 52 extending in the sub scanning direction. The unit main body 51 is configured to be guided by the rail 52 and reciprocated in a wiping direction (corresponding to a first direction in the invention) extending in the sub scanning direction, which is indicated by an outlined arrow, by a wiper transferring mechanism including a rack gear, a pinion gear, and a driving source, which are not illustrated. The unit main body 51 houses a first roll 56 around which a sheet-shaped wiper 9 formed of a cloth, such as knitted fabrics, woven fabrics, and nonwoven fabrics, i.e., fibrous materials, is wound, and a second roll 57 on which the wiper 9 after wiping is wound.

The first roll 56 and the second roll 57 are supported by shafts with a predetermined distance therebetween in the wiping direction. The first roll 56 includes an unused wiper 9 wound around a first shaft 58. The wiper 9 is sequentially unwound and sent toward the second roll 57 during the wiping operation. The second roll 57 includes the used wiper 9 (that has wiped the nozzle forming surface 23) wound around a second shaft 59. Two pressing rollers 60*a* and 60*b* are arranged side by side in the wiping direction at a position between and above the first roll 56 and the second roll 57 in the wiping direction (at a side adjacent to the nozzle forming surface 23). The wiper 9 unwound from the first roll 56 is stretched across the pressing rollers 60*a* and 60*b* and the end thereof is wound up by the second roll 57.

The pressing rollers 60*a* and 60*b* are respectively supported by freely rotating shafts 61*a* and 61*b* in such a manner that the pressing rollers 60*a* and 60*b* are rotated in accordance with the rotation of the first roll 56 and the second roll 57. A casing 53 has an opening 62 in the middle of the upper surface or the surface facing the nozzle forming surface 23 of the recording head 2. A portion (an upper portion) of each of the pressing rollers 60*a* and 60*b* in the casing 53 protrudes to the outside through the opening 62 toward the nozzle forming surface 23. Thus, a portion of the wiper 9 stretched across the pressing rollers 60*a* and 60*b* (a wiping region) also protrudes toward the nozzle forming surface 23 beyond the upper surface of the casing 53 and faces the nozzle forming surface 23. The freely rotating shafts 61*a* and 61*b* of the pressing rollers 60*a* and 60*b* are biased to the upper side, i.e., toward the nozzle forming surface 23, by a biasing member such as a spring, which is not illustrated. Thus, the wiping region of the wiper 9 is biased toward the nozzle forming surface 23 by the pressing rollers 60*a* and 60*b*. In this embodiment, the space between the pressing rollers 60*a* and 60*b* in the wiping direction (a distance between the shafts) is smaller than the space between the first roll 56 and the second roll 57 in the wiping direction (a distance between the shafts) and larger than the dimension of the nozzle forming surface 23 in the wiping direction. With this configuration, as described later, spaces 64 are able to be readily made larger by applying tension to the wiper 9 from the both ends in the wiping direction.

A cleaning liquid dispenser 63, which is configured to store the cleaning liquid and apply the cleaning liquid to the surface of the wiper 9, is disposed between the first roll 56 and the pressing roller 60*a*. The cleaning liquid includes the same kind of liquid (the same components) as the solvent in the ink to be ejected through the nozzles 40 of the recording head 2. For example, the cleaning liquid includes polyethyleneglycol. The cleaning liquid is applied from the cleaning dispenser 63 to the wiping region of the wiper 9 before the wiping region of the wiper 9 comes in contact with the nozzle forming surface 23 (before the wiping region of the wiper 9 reaches the position facing the nozzle forming surface 23). Thus, the ink or the aggregation substances adhered to the nozzle forming surface 23 are more readily removed. In the example of this embodiment, the cleaning liquid is applied to the wiper 9, but the invention is not limited to this configuration. The cleaning liquid may be applied to the nozzle forming surface 23.

Figure 6:
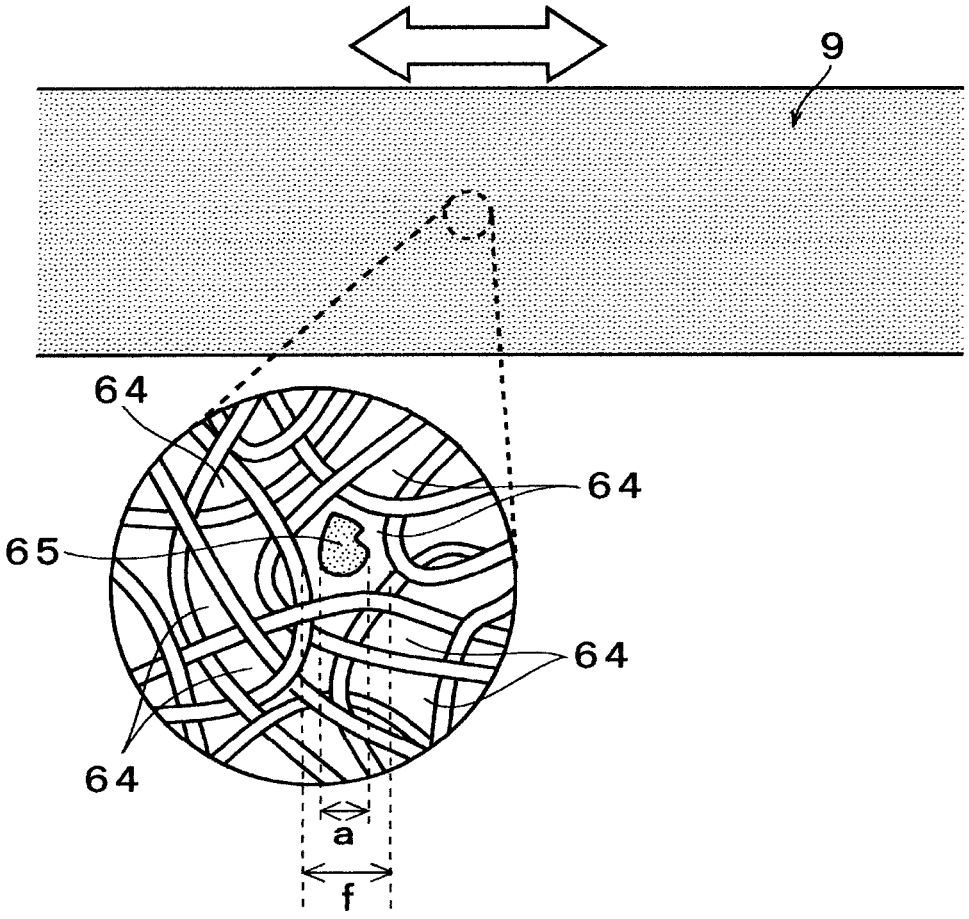
FIG. 6 is a plan view illustrating a configuration of a wiping member (a wiper) according to an embodiment.

FIG. 6 is a plan view illustrating the wiper 9. In FIG. 6, a portion of the wiper 9 is magnified. The arrow in FIG. 6 indicates the wiping direction in the wiping operation. The wiper 9 in this embodiment is a thin fibrous material (fabric) including natural fibers or chemical fibers such as woven fabrics (cloth), knitted fabrics, and nonwoven fabrics. The width (the dimension in the main scanning direction) of the wiper 9 is longer than the dimension of the nozzle forming surface 23 of the recording head 2 in the main scanning direction. This enables the wiper 9 to wipe the entire area of the nozzle forming surface 23 during the wiping operation. Since the wiper 9 is formed of a fibrous material, there are spaces 64 between the fibers. The fibrous material may include an adhesive or the like, other than the fibers, to connect the fibers.

Figure 7:
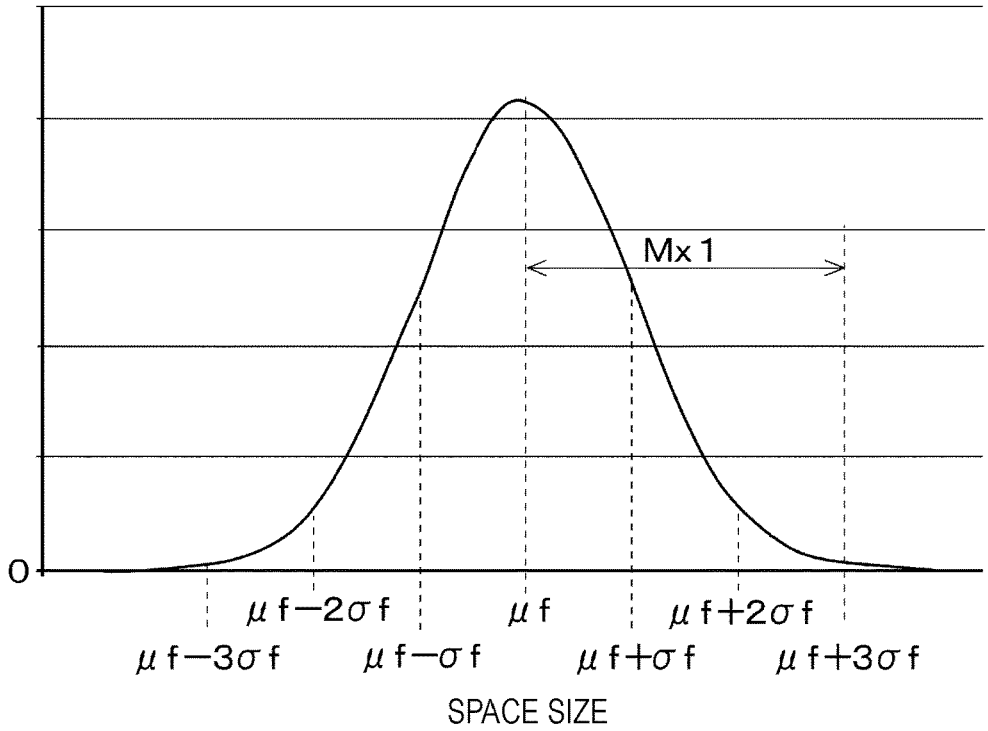
FIG. 7 is a view indicating a normal distribution of sizes of spaces between fibers.
Figure 8:
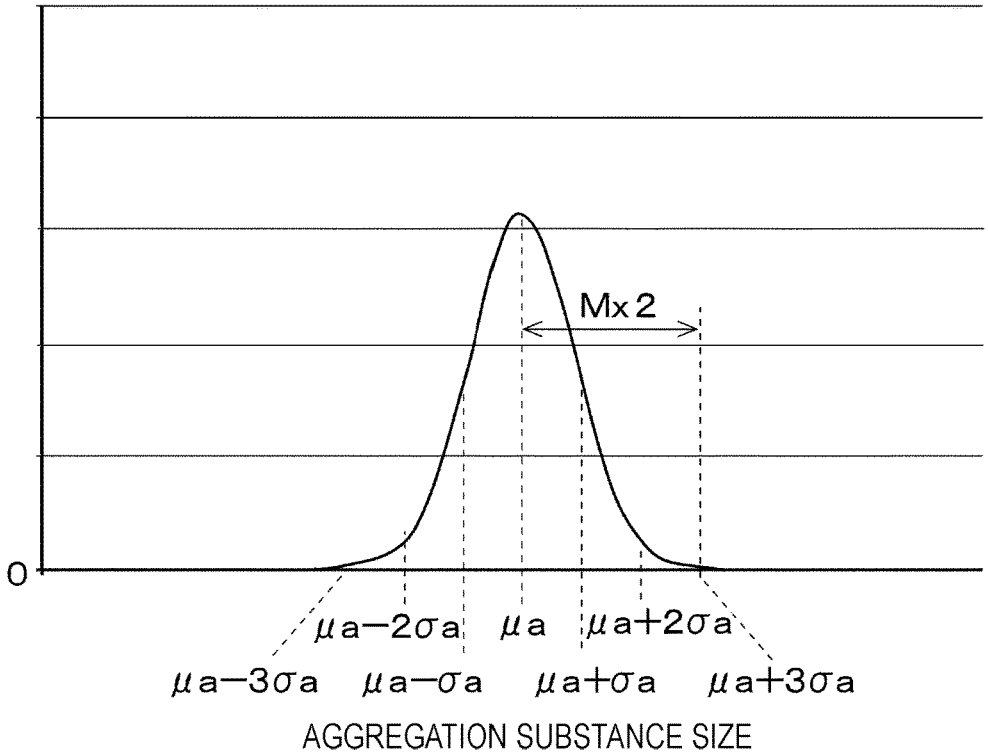
FIG. 8 is a view indicating a normal distribution of sizes of aggregation substances.

FIG. 7 is a graph indicating one example of a normal distribution of spaces (sizes of the spaces 64) between the fibers of the wiper 9 in the wiping direction. More specifically, the graph indicates the normal distribution of the sizes of the spaces 64 in the wiping direction in a region of the wiper 9 that comes in contact with the nozzle forming surface 23 during the wiping operation. FIG. 8 is a graph indicating one example of a normal distribution of sizes of the aggregation substances 65 on the nozzle forming surface 23 in the wiping direction. The sizes of the aggregation substances 65 are sizes at the time of wiping the nozzle forming surface 23 by the wiping mechanism 7. The sizes of the spaces 64 in the wiper 9 in the embodiment are set as follow to make the nozzle forming surface 23 having the aggregation substances 65 thereon less likely to be damaged by the wiping operation. In other words, the spaces 64 are set to satisfy the following condition (1):

$$\mu a+3\sigma a \leq \mu f+3\sigma f \quad (1)$$

where μf is an average of sizes of the spaces 64 (spaces between fibers) in the wiping direction, σf is a standard deviation of the sizes of the spaces 64 in the wiping direction, μa is an average of the sizes of the aggregation substances 65 adhered to the nozzle forming surface 23 in the wiping direction, and σa is a standard deviation of the sizes of the aggregation substances in the wiping direction.

That is, when M×1 (=μf+3σf) in FIG. 7 is equal to or larger than M×2(=μa+3σa) in FIG. 8, almost all the aggregation substances 65 on the nozzle forming surface 23 are caught in the spaces 64. In other words, by reference to the normal distribution, the sizes of almost all (about 99.7%) the aggregation substances 65 are within a range of μa±3σa, and the sizes of almost all the spaces 64 are within a range of μf±3σf, and thus almost all the aggregation substances 65 are able to be caught in the spaces 64 when the above-described condition (1) is satisfied, if the average μf of the sizes of the spaces 64 and the average μa of the sizes of the aggregation substances 65 do not differ widely from each other. The area density of the spaces 64 in the wiper 9 is preferably larger than the area density of the aggregation substances 65 on the nozzle forming surface 23. This enables more aggregation substances 65 to be more reliably caught in the spaces 64.

It is more preferable that the average μf of the sizes of the spaces 64 satisfy the following condition (2):

$$\mu a-2\sigma a \leq \mu f \leq \mu a+2\sigma a \quad (2).$$

When the condition (2) is satisfied, the average μf of the sizes of the spaces 64 and the average μa of the sizes of the aggregation substances 65 are close to each other, and thus almost all the aggregation substances 65 are able to be more reliably caught in the spaces 64 during the wiping operation. The average μf is preferably (μa+2σa) or smaller, because the average μf of the sizes of the spaces 64 larger than (μa+2σa) means that the spaces 64 are larger than necessary, which is waste, and this may lower the wiping properties of the wiper 9 during the wiping operation and produce an adverse effect.

The average μa of the sizes of the aggregation substances 65 is able to be estimated from the total ejection amount (the total discharge number) of the ink ejected from the recording head 2 between the previous wiping operation and the current wiping operation (the elapsed time). The relationship between the elapsed time or the total ejection amount and the average of the sizes μa of the aggregation substances 65 is obtained in advance through an experiment, for example. A table or the like including the calculation formula or the relationship is stored in the memory 14 or the like as information about the sizes of the aggregation substances. Thus, when the wiping operation is performed, the average μa of the sizes of the aggregation substances 65 is able to be estimated based on the elapsed time between the previous wiping operation and the current wiping operation or the total ejection amount. In this embodiment, if the estimated average μa does not satisfy the above-described condition (1), the tension applied to the wiper 9 is increased to make the spaces 64 larger in the wiping direction and to satisfy the condition (1). This will be described later.

Figure 9:
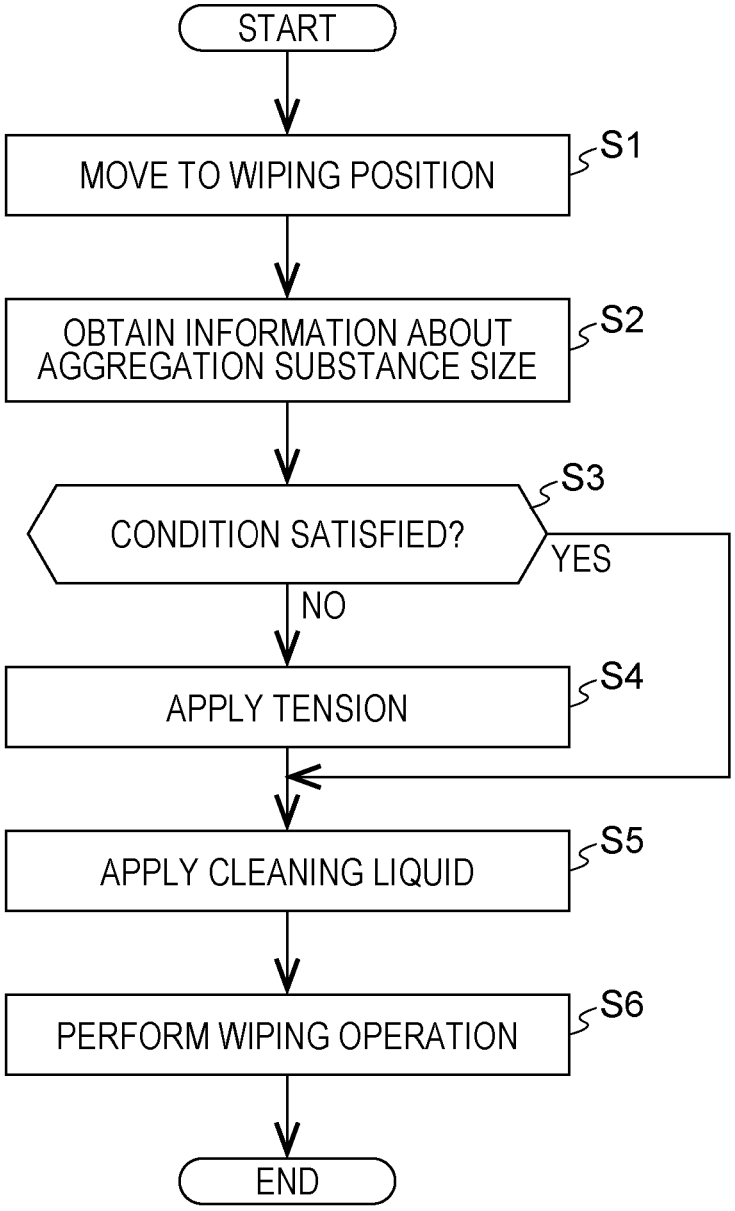
FIG. 9 is a flow chart of a cleaning operation (a wiping operation).

FIG. 9 is a flow chart for explaining the wiping operation performed by the wiping mechanism 7, i.e., a wiping method in the cleaning mechanism and the method of controlling the liquid ejecting apparatus according to the invention. The wiping operation may be performed periodically. For example, the wiping operation is performed when a predetermined condition is satisfied, such as when an elapsed time after the previous wiping operation exceeds a threshold value, and when the total ejection amount of ink ejected from the recording head 2 after the previous wiping operation exceeds a threshold value. In this embodiment, the wiping operation is performed when the elapsed time exceeds the threshold value. Then, when the time has come to perform the wiping operation, the CPU 13 controls the carriage transferring mechanism 18 to move the carriage 3 having the recording head 2 thereon to the wiping position above the wiping mechanism 7 (Step S1). Subsequently, the CPU 13 retrieves the information about the sizes of the aggregation substances from the memory 14 and estimates the average μa of the sizes of the aggregation substance 65 as of this moment (Step S2).

After the average μa of the sizes of the aggregation substances 65 is estimated as above, it is determined whether the above-described condition (1) is satisfied based on the estimated average μa (Step S3). If it is determined that the condition (1) is satisfied (Yes), the step S4 is skipped, and the process proceeds to Step S5. On the other hand, if it is determined that the condition (1) is not satisfied (No), the CPU 13 controls the wiping mechanism 7 to increase the tension applied to the wiper 9 in the wiping direction to make the spaces 64 larger in the wiping direction such that the condition (1) is satisfied (Step S4). In other words, a force is applied to the wiper 9 such that the spaces between the fibers of the wiper 9 in the wiping direction become larger than the sizes of the aggregation substances 65 in the wiping direction. More specifically, as indicated by two hatched arrows in FIG. 5, the first roll 56 and the second roll 57 are each rotated in such a direction as to wind up the wiper 9, and thus the tension is applied to the wiper 9 in the opposite directions from the opposing sides in the wiping direction, as indicated by two black arrows in FIG. 5. In this operation, the wiping mechanism 7 changes the tension depending on the elapsed time from the previous wiping operation or the total ejection amount. Specifically, the size of the aggregation substance 65 increases as the elapsed time from the previous wiping operation becomes longer or as the total ejection amount of ink ejected from the recording head 2 increases, and thus a degree of the tension is increased accordingly. In this embodiment, when the condition (1) is satisfied by making the spaces 64 larger, the wiping mechanism 7 does not make the spaces 64 larger any more (does not increase the tension any more). As described above, since the tension is varied depending on the elapsed time from the previous wiping operation or the total ejection amount, the aggregation substances 65 are more effectively caught in the spaces 64 in the wiper 9 during the wiping operation. In particular, this configuration is preferably applied to the wiper 9 having spaces (the spaces 64) between the fibers with no tension (force) being applied smaller than the aggregation substances 65 at the time of the wiping operation. In addition, since the spaces 64 are not made larger more than necessary, the wiping properties of the wiper 9 are less likely to be lowered.

Subsequently, the cleaning liquid is applied to the surface of the wiper 9 (the wiping region) from the cleaning dispenser 63 (Step S5). After the application of the cleaning liquid, the first roll 56 starts to rotate in such a direction as to send out the wiper 9, and the second roll 57 starts to rotate in such a direction as to wind up the wiper 9. Thus, the wiping region of the wiper 9 into which the cleaning liquid is soaked is sent to the position facing the nozzle forming surface 23 between the pressing roller 60*a* and the pressing roller 60*b*. In this state, the unit body 51 moves in the wiping direction while the wiper 9 is in contact with the nozzle forming surface 23 to perform the wiping operation (Step S6). In other words, the wiper 9 wipes the nozzle forming surface 23.

As described above, the wiping operation performed with the above-described condition (1) being satisfied allows the aggregation substances 65 on the nozzle forming surface 23 to be readily caught in the spaces 64 in the wiper 9. Since the aggregation substances 65 are caught in the spaces 64, the nozzle forming surface 23 is less likely to be rubbed by aggregation substances 65 sandwiched between the fibers of the wiper 9 and the nozzle forming surface 23. Thus, the liquid-repellent film 47 on the nozzle forming surface 23 is less likely to be damaged and worn by the aggregation substances 65, reducing deterioration of the liquid-repellent film 47 (a reduction in the liquid-repellent properties). This reduces defects such as curve in the flying direction of the ink droplets caused by deterioration in the liquid-repellent properties of the liquid-repellent film 47. In the printer 1 including the wiping mechanism 7 provided with the wiper 9, the liquid-repellent film 47 on the nozzle forming surface 23 of the recording head 2 is less likely to be damaged and worn by the aggregation substances 65, reducing deterioration in the liquid-repellent properties. This leads to an improvement in resistance of the recording head 2.

Furthermore, in the embodiment, the size of the aggregation substance 65 is estimated by using the elapsed time from the previous wiping operation or the total ejection amount of ink ejected from the recording head 2 after the previous wiping operation, and the wiping operation is performed in accordance with the estimated size to satisfy the condition (1). Thus, the frequency of the wiping operation is reduced to the maximum extent possible. Thus, a throughput of the printer 1 is able to be improved accordingly. This leads to an improvement in productivity of printed matters or the like to be produced by the printer 1.

Figure 10:
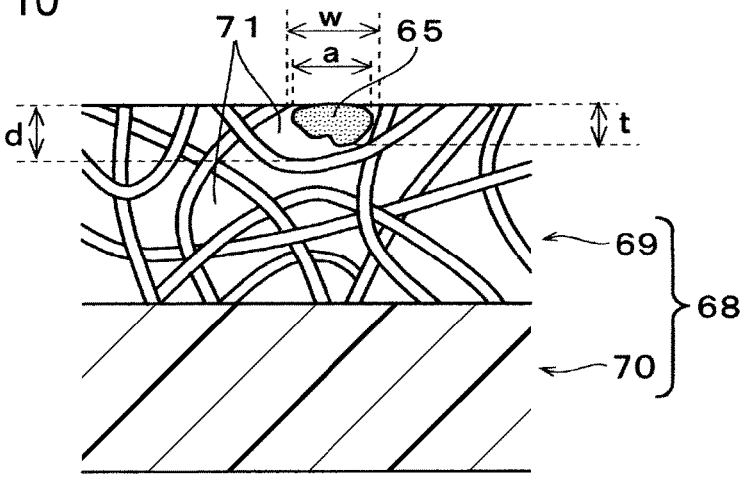
FIG. 10 is a cross-sectional view illustrating a configuration of a wiping member according to a second embodiment.

Next, a second embodiment of the invention will be described. FIG. 10 is a cross-sectional view of a wiper 68 (one example of the wiping member) according to the second embodiment taken in the thickness direction. In the first embodiment, the wiper 9 formed of a relatively thin cloth is described as an example, but the wiper is not limited to this, and the wiper 68 having a larger thickness may be employed. The wiper 68 may have a multilayered structure. The wiper 68 in this embodiment has a two-layered structure including a first layer 69, which comes in contact with the nozzle forming surface 23 during the wiping operation, and a second layer 70, which comes in contact with the pressing rollers 60*a* and 60*b*. The first layer 69 is formed of a similar fibrous material to the wiper 9 in the first embodiment and is thicker than the wiper 9. The first layer 69 has spaces 71 between the fibers to catch the aggregation substances 65 on the nozzle forming surface 23. The second layer 70 in this embodiment is formed of an elastic material that does not readily slide on the pressing rollers 60*a* and 60*b*, for example, a porous elastomer. The wiper 68 may have three or more layers. In such a case, at least the layer that comes in contact with the nozzle forming surface 23 during the wiping operation includes the spaces 71 that are able to catch the aggregation substances 65. As the above-described configurations, since the wiper 68 includes another layer (the second layer 70) in addition to the layer configured to catch the aggregation substances 65 (the first layer 69), the wiper 68 is able to be provided with another property such as an improved elasticity.

This embodiment satisfies the following conditions (3) and (4) are satisfied:

$$\mu a1+3\sigma a1 \leq \mu s1+3\sigma s1 \quad (3); \text{ and}$$

$$\mu a2+3\sigma a2 \leq \mu s2+3\sigma s2 \quad (4)$$

where μs1 is an average of dimensions (widths) w of the spaces 71 in the wiping direction during the wiping operation, σs1 is a standard deviation of the widths w of the spaces, μs2 is an average of depths d of the spaces 71 in the thickness direction (corresponding to a second direction in the invention) of the wiper 68, σs2 is a standard deviation of the depths d, μa1 is an average of sizes a of the aggregation substances 65 in the wiping direction, σa1 is a standard deviation of the sizes a of the aggregation substances, μa2 is an average of thicknesses t (a protruded length from the nozzle forming surface 23) of the aggregation substances 65, and **6*a*2 is a standard deviation of the thicknesses t of the aggregation substances 65**.

The wiper 68 that satisfies the above-described conditions (3) and (4) readily catches the aggregation substances 65 on the nozzle forming surface 23 in the spaces 71 during the wiping operation. The spaces 71 that satisfy the conditions preferably have an area density larger than that of the aggregation substances 65 on the nozzle forming surface 23. With this configuration, more aggregation substances 65 are able to be more reliably caught.

As in the first embodiment, it is more preferable that the average μs1 of the widths w of the spaces 71 and the average μs2 of the depths d of the spaces 71 satisfy the following conditions (5) and (6):

$$\mu a1-2\sigma a1 \leq \mu s1 \leq \mu a1+2\sigma a1 \quad (5); \text{ and}$$

$$\mu a2-2\sigma a2 \leq \mu s2 \leq \mu a2+2\sigma a2 \quad (6).$$

This allows the average μs1 of the widths w of the spaces 71 and the average μa1 of the sizes a of the aggregation substances 65 to be close to each other and the average μs2 of the depths d of the spaces 71 and the average μa2 of the thicknesses t of the aggregation substances 65 to be close to each other, and thus almost all the aggregation substances 65 are more reliably caught in the spaces 71 by the wiping operation. As the average μf of the sizes of the spaces 64 in the first embodiment, if the average μs1 of the widths w of the spaces 71 and the average μs2 of the depths d of the spaces 71 exceed (μa1+2σa1) and (μa2+2σa2), respectively, the wiping properties during the wiping operation would be lowered. Thus, the averages μs1 and μs2 are preferably to be (μa1+2σa1) or less and (μa2+2σa2) or less, respectively.

In the wiping mechanism 7 including the wiper 68 according to this embodiment, when the tension applied to the wiper 68 needs to be varied depending on the elapsed time from the previous wiping operation or the total ejection amount, the spaces 71 are made larger to satisfy the conditions (3) and (4).

In this embodiment, the aggregation substances 65 on the nozzle forming surface 23 are caught in the spaces 71 in the wiper 68 by the wiping operation performed with the above-conditions (3) and (4) being satisfied. Since the aggregation substances 65 are caught in the spaces 71, the nozzle forming surface 23 is less likely to be rubbed by the aggregation substances 65 sandwiched between the fibers of the wiper 68 and the nozzle forming surface 23. Thus, the liquid-repellent film 47 on the nozzle forming surface 23 is less likely to be damaged and worn by the aggregation substances 65, reducing deterioration in the liquid-repellent properties. This leads to a reduction in defects such as curve in the flying direction of ink droplets caused by the lowered liquid-repellent properties of the liquid-repellent film 47. The other components are the same as those in the first embodiment.

Figure 11:
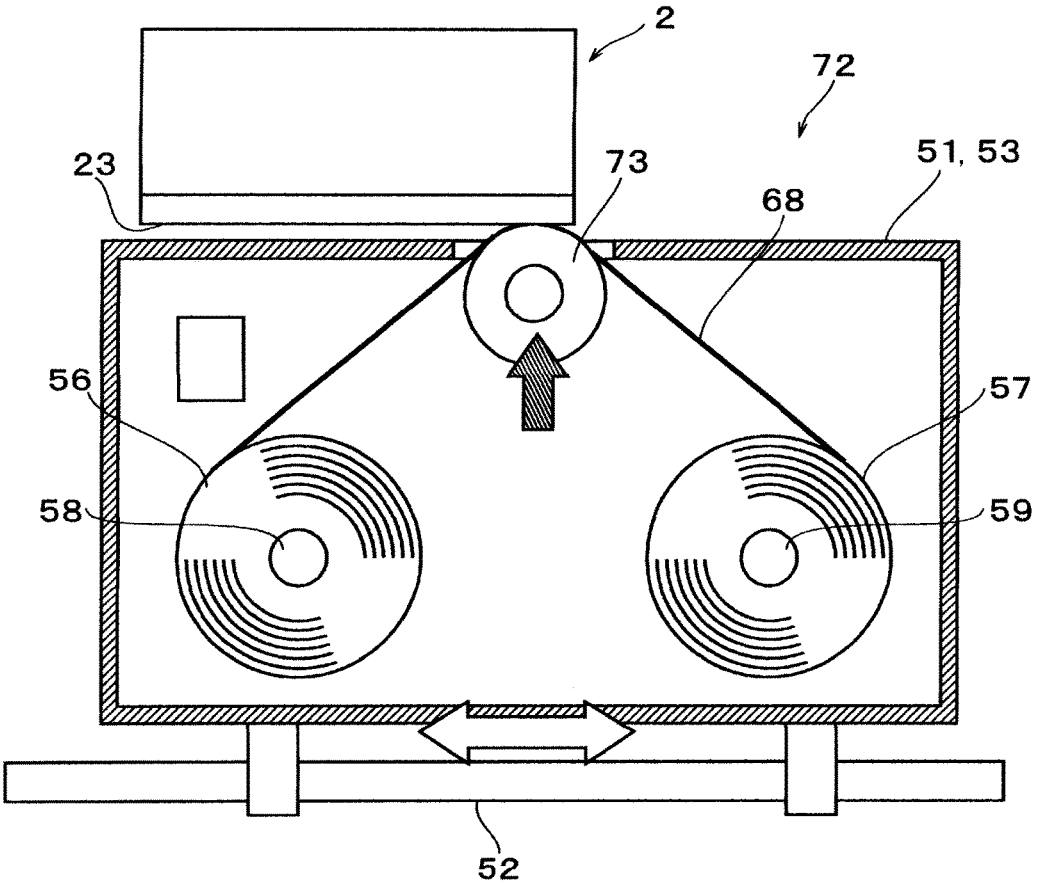
FIG. 11 is a cross-sectional view illustrating a configuration of a cleaning mechanism according to a modified example.

FIG. 11 is a view for explaining a modification of the wiping mechanism. In the wiping mechanism 7 illustrated in FIG. 5, the wiper 9 is stretched across the two pressing rollers **60*a* and 60*b*, but a wiping mechanism 72 in this modification differs from the wiping mechanism 7 in that only one pressing roller 73 is disposed. In this configuration, during the wiping operation, the nozzle forming surface 23 is wiped over a narrow region that comes in contact with the pressing roller 73, and thus a pressure applied to the nozzle forming surface 23 is large compared to that in the wiping mechanism 7. In this configuration, the wiper 68 in the second embodiment is preferably employed. Since the second layer 70 of the wiper 68 has elasticity, the second layer 70 buffers the pressure applied to the surface during the wiping. This configuration reduces the damage to the liquid-repellent film 47 over which the aggregation substances 65 sandwiched between the wiper 68 and the nozzle forming surface 23 are dragged. Furthermore, this configuration reduces the possibility that the first layer 69 will be pressed in the thickness direction to have smaller spaces 71 (an apparent volume). Thus, the aggregation substances 65 on the nozzle forming surface 23 are more reliably caught. The other components of the wiping mechanism 72 are the same as those of the wiping mechanism 7 in FIG. 5**.

In the example in the first embodiment, when the above-described condition (1) is determined not to be satisfied based on the estimated average μa of the sizes of the aggregation substances 65, the tension applied to the wiper 9 in the wiping direction is increased to make the spaces 64 in the wiping direction larger such that the condition (1) is satisfied. However, the invention is not limited to this configuration, and the wiping operation may be performed without increasing the tension (force) to be applied to the wiper 9. In such a case, without making the spaces 64 of the wiper 9 larger, the wiping operation may be performed when the equation μa+3σa=μf+3σf is satisfied (or shortly before the equation is satisfied) based on the average μa of the sizes of the aggregation substances 65 estimated based on the elapsed time from the previous wiping operation or the total ejection amount (total ejection numbers) of the ink ejected from the recording head 2 after the previous wiping operation. With this configuration, a wiping member formed of a fibrous material in which the spaces 64 are not readily made larger by application of a higher tension is also allowed to catch the aggregation substances 65 on the nozzle forming surface 23 in the spaces 64 during the wiping operation.

In the second embodiment, the wiping operation may also be performed without making the spaces 71 of the wiper 68 larger by using the estimated averages μa1 and μa2 relating to the aggregation substances 65. The wiping operation may be performed when one of the equations: μa1+3σa1=μs1+3σs1 and μa2+3σa2=μs2+3σs2 is satisfied (or shortly before one of them is satisfied). With this configuration, a wiping member formed of a fibrous material having the spaces 71 not readily made larger by application of a higher tension is allowed to catch the aggregation substances 65 on the nozzle forming surface 23 in the spaces 71 during the wiping operation.

Regarding the condition (1), if the aggregation substances 65 are relatively soft, for example, and are readily removal from the nozzle forming surface 23, the condition (1) may be eased as follow:

$$\mu a+2\sigma a \leq \mu f+2\sigma f \quad (7).$$

The above-described conditions (3) and (4) may also be eased as follow:

$$\mu a1+2\sigma a1 \leq \mu s1+2\sigma s1 \quad (8); \text{ and}$$

$$\mu a2+2\sigma a2 \leq \mu s2+2\sigma s2 \quad (9).$$

The operation frequency of the wiping operation is reduced by the ease of the conditions. This allows the printer 1 to have further improved throughput accordingly. Thus, the productivity of printed matters or the like to be produced by the printer 1 is improved.

Furthermore, in the examples in the embodiments, the unit body 51 is moved in the wiping direction with the wiper 9 being in contact with the nozzle forming surface 23 to perform the wiping operation. However, the invention is not limited to this configuration. The wiper 9 may be turned with the nozzle forming surface 23 and the unit body 51 facing each other with a predetermined distance therebetween to perform the wiping operation. Alternatively, the recording head 2 may be moved in the wiping direction to perform the wiping operation, without driving of the wiping mechanism 7. In short, only the wiper 9 and the nozzle forming surface 23 need to be moved relative to each other to perform the wiping operation.

In the above-described example, the invention is applied to the wiping member (the wiper 9) configured to wipe the nozzle forming surface 23 of the recording head 2 of the printer 1, but the invention is not limited to this. The invention may be applied to any wiping member configured to wipe a nozzle forming surface of a liquid ejecting head configured to eject liquid. For example, the invention may be applied to a wiping member configured to wipe a nozzle forming surface of a color material ejecting head used in manufacturing of a color filter of a liquid crystal display, for example, an electrode material ejecting head used in forming an electrode of an organic electro luminescence (EL) display or a surface-emitting display (FED), or a bio-organic material ejecting head used in manufacturing of bio tips.

The entire disclosure of Japanese Patent Application No. 2017-049706, filed Mar. 15, 2017 is expressly incorporated by reference herein.

What is claimed is:

1. A wiping member configured to wipe a nozzle forming surface of a liquid ejecting head, which has nozzles through which a liquid is ejected, in a first direction, the wiping member comprising a fibrous material and configured to satisfy the following:

$$\mu a+3\sigma a \leq \mu f+3\sigma f$$

where μf is an average of sizes of spaces between fibers in the first direction, σf is a standard deviation of the sizes of the spaces, μa is an average of sizes of aggregation substances formed of a solute in the liquid adhered to the nozzle forming surface in the first direction, and σa is a standard deviation of the sizes of the aggregation substances.

2. The wiping member according to claim 1, wherein the average μf of the sizes of the spaces satisfies the following:

$$\mu a-2\sigma a \leq \mu f \leq \mu a+2\sigma a.$$

3. The wiping member according to claim 1, wherein an area density of the spaces is larger than an area density of the aggregation substances on the nozzle forming surface.

4. A wiping member configured to wipe a nozzle forming surface of a liquid ejecting head, which has nozzles through which liquid is ejected, in a first direction, the wiping member including a fibrous material, wherein the wiping member has spaces capable of catching aggregation substances formed of a solute of the liquid attached to the nozzle forming surface between fibers, and the wiping member satisfies the following:

$$\mu a1+3\sigma a1 \leq \mu s1+3\sigma s1; \text{ and}$$

$$\mu a2+3\sigma a2 \leq \mu s2+3\sigma s2$$

where μs1 is an average of widths of the spaces in the first direction, σs1 is a standard deviation of the widths of the spaces, μs2 is an average of depths of the spaces in a second direction extending in a thickness direction of the wiping member, σs2 is a standard deviation of the depths of the spaces, μa1 is an average of sizes of the aggregation substances in the first direction, σa1 is a standard deviation of the sizes of the aggregation substances, μa2 is an average of thicknesses of the aggregation substances in the second direction, and σa2 is a standard deviation of the thicknesses of the aggregation substances.

5. The wiping member according to claim 4, wherein the average μs1 of the widths of the spaces and the average μs2 of the depths of the spaces respectively satisfy the following:

$$\mu a1-2\sigma a1 \leq \mu s1 \leq \mu a1+2\sigma a1; \text{ and}$$

$$\mu a2-2\sigma a2 \leq \mu s2 \leq \mu a2+2\sigma a2.$$

6. The wiping member according to claim 4, wherein an area density of the spaces is larger than an area density of the aggregation substances on the nozzle forming surface.

7. The wiping member according to claim 4, wherein the wiping member includes a plurality of layers arranged in the second direction, and at least one of the plurality of layers that is in contact with the nozzle forming surface has the spaces.

8. A liquid ejecting apparatus comprising:

a liquid ejecting head having a nozzle forming surface having nozzles through which liquid is ejected; and a cleaning mechanism configured to wipe the nozzle forming surface by using the wiping member according to claim 1.

9. A liquid ejecting apparatus comprising:

a liquid ejecting head having a nozzle forming surface having nozzles through which liquid is ejected; and a cleaning mechanism configured to wipe the nozzle forming surface by using the wiping member according to claim 2.

10. A liquid ejecting apparatus comprising:

a liquid ejecting head having a nozzle forming surface having nozzles through which liquid is ejected; and a cleaning mechanism configured to wipe the nozzle forming surface by using the wiping member according to claim 3.

11. A liquid ejecting apparatus comprising:

a liquid ejecting head having a nozzle forming surface having nozzles through which liquid is ejected; and a cleaning mechanism configured to wipe the nozzle forming surface by using the wiping member according to claim 4.

12. A liquid ejecting apparatus comprising:

a liquid ejecting head having a nozzle forming surface having nozzles through which liquid is ejected; and a cleaning mechanism configured to wipe the nozzle forming surface by using the wiping member according to claim 5.

13. A liquid ejecting apparatus comprising:

a liquid ejecting head having a nozzle forming surface having nozzles through which liquid is ejected; and a cleaning mechanism configured to wipe the nozzle forming surface by using the wiping member according to claim 6.

14. A liquid ejecting apparatus comprising:

a liquid ejecting head having a nozzle forming surface having nozzles through which liquid is ejected; and a cleaning mechanism configured to wipe the nozzle forming surface by using the wiping member according to claim 7.

15. A wiping method in a cleaning mechanism of wiping a nozzle forming surface of a liquid ejecting head having nozzles through which liquid is ejected by using the wiping member according to claim 1, the method comprising:

applying a force to the wiping member such that a space between the fibers of the wiping member is made larger than a size of the aggregation substances in the first direction and wiping the nozzle forming surface with the wiping member.

16. A wiping method in a cleaning mechanism of wiping a nozzle forming surface of a liquid ejecting head having nozzles through which liquid is ejected by using the wiping member according to claim 2, the method comprising:

applying a force to the wiping member such that a space between the fibers of the wiping member is made larger than a size of the aggregation substances in the first direction and wiping the nozzle forming surface with the wiping member.

17. A wiping method in a cleaning mechanism of wiping a nozzle forming surface of a liquid ejecting head having nozzles through which liquid is ejected by using the wiping member according to claim 3, the method comprising:

applying a force to the wiping member such that a space between the fibers of the wiping member is made larger than a size of the aggregation substances in the first direction and wiping the nozzle forming surface with the wiping member.

18. The wiping method in the cleaning mechanism according to claim 15, wherein the force is varied depending on an elapsed time from previous wiping or a total ejection amount of the liquid ejected from the liquid ejecting head.

19. The wiping method in the cleaning mechanism according to claim 15, further comprising applying a cleaning liquid including the same kind of liquid as a solvent in the liquid to the nozzle forming surface or the wiping member before the wiping member comes in contact with the nozzle forming surface.

20. A method of controlling a liquid ejecting apparatus that includes a liquid ejecting head having a nozzle forming surface having nozzles through which liquid is ejected and a cleaning mechanism configured to wipe the nozzle forming surface with a wiping member, wherein the wiping method in a cleaning mechanism according to claim 15 is employed.

* * * * *